US008133039B2

(12) United States Patent
Anderson et al.

(10) Patent No.: US 8,133,039 B2
(45) Date of Patent: Mar. 13, 2012

(54) MOUNT FOR A COMPRESSION CONTROL UNIT

(75) Inventors: Kelly M. Anderson, Kirkwood, MO (US); David Rork Swisher, St. Charles, MO (US); James G. Hanlon, Manchester, MO (US)

(73) Assignee: Tyco Healthcare Group LP, Mansfield, MA (US)

( * ) Notice: Subject to any disclaimer, the term of this patent is extended or adjusted under 35 U.S.C. 154(b) by 582 days.

(21) Appl. No.: 12/359,793

(22) Filed: Jan. 26, 2009

(65) Prior Publication Data

US 2010/0189578 A1 Jul. 29, 2010

(51) Int. Cl.
*B65H 75/34* (2006.01)
*F04B 53/00* (2006.01)

(52) U.S. Cl. ..... 417/360; 137/355.16; 137/355.17; 137/355.26; 248/75; 248/89; 417/234

(58) Field of Classification Search ..... 137/355.16, 137/355.17, 355.26; 248/75, 89; 417/234, 417/360; 601/148–153
See application file for complete search history.

(56) References Cited

U.S. PATENT DOCUMENTS

| | | | | |
|---|---|---|---|---|
| 878,394 | A | | 2/1908 | Holle |
| 1,999,225 | A | | 4/1935 | Williamson |
| 2,033,491 | A | | 3/1936 | Sprague et al. |
| 2,607,881 | A | | 8/1952 | Anderson |
| 2,945,946 | A | | 7/1960 | Moffatt |
| 3,030,639 | A | | 4/1962 | Boyer |
| 3,075,723 | A | | 1/1963 | Wohlfeil |
| 3,757,363 | A | | 9/1973 | Langlais |
| 4,101,089 | A | | 7/1978 | Culbertson et al. |
| 4,262,872 | A | | 4/1981 | Kodet |
| 4,443,128 | A | | 4/1984 | Yamamoto et al. |
| 4,444,548 | A | * | 4/1984 | Andersen et al. ..... 417/63 |
| 4,487,523 | A | | 12/1984 | Monroe |
| 4,547,092 | A | | 10/1985 | Vetter et al. |
| 4,576,501 | A | | 3/1986 | McConnell |
| 4,593,422 | A | | 6/1986 | Wolpert, Jr. et al. |
| 4,676,687 | A | | 6/1987 | Koffler |

(Continued)

FOREIGN PATENT DOCUMENTS

DE 42 08 128 9/1992

(Continued)

OTHER PUBLICATIONS

European Search Report dated Apr. 28, 2010.

*Primary Examiner* — Nimeshkumar Patel
*Assistant Examiner* — Steven Horikoshi
(74) *Attorney, Agent, or Firm* — Thomas M. Johnston, Esq.

(57) ABSTRACT

A compression control unit for a compression device includes a mount on the back of a housing for mounting the compression control unit on a bed unit. The mount includes a securing portion spaced from a back of the housing and lying in a plane generally opposing the back of the housing. The securing portion partially defines a channel for receiving a part of the bed unit to secure the compression control unit to the bed unit. Spaced apart wing portions extend generally upward and laterally outward relative to the securing portion. The wing portions are configured so that fluid tubing secured to an outlet of the compression control unit can be wrapped around the wing portions when the compression control unit is mounted on the bed unit.

18 Claims, 11 Drawing Sheets

U.S. PATENT DOCUMENTS

| | | | | | |
|---|---|---|---|---|---|
| 4,695,025 | A | | 9/1987 | Vaughan | |
| 4,699,344 | A | | 10/1987 | Vaughan | |
| 4,702,448 | A | | 10/1987 | LoJacono et al. | |
| 4,742,981 | A | | 5/1988 | Converse | |
| 4,796,846 | A | | 1/1989 | Meier et al. | |
| 4,865,484 | A | | 9/1989 | McConnell | |
| 4,872,224 | A | | 10/1989 | Grimes et al. | |
| 4,885,667 | A | | 12/1989 | Selden | |
| 4,903,922 | A | * | 2/1990 | Harris, III | 248/75 |
| 4,970,900 | A | | 11/1990 | Shepherd et al. | |
| 4,988,062 | A | | 1/1991 | London | |
| 5,025,780 | A | | 6/1991 | Farley | |
| 5,108,213 | A | | 4/1992 | Shields | |
| 5,118,127 | A | | 6/1992 | Partington | |
| 5,163,752 | A | | 11/1992 | Copeland et al. | |
| 5,242,240 | A | | 9/1993 | Gorham | |
| 5,275,390 | A | | 1/1994 | Brennan | |
| 5,320,444 | A | | 6/1994 | Bookwalter et al. | |
| 5,334,186 | A | | 8/1994 | Alexander | |
| 5,340,069 | A | | 8/1994 | Niemeyer | |
| 5,368,267 | A | | 11/1994 | Howard | |
| 5,540,561 | A | * | 7/1996 | Johnson | 417/234 |
| 5,582,379 | A | | 12/1996 | Keselman et al. | |
| 5,588,166 | A | | 12/1996 | Burnett | |
| 5,615,682 | A | | 4/1997 | Stratz, Sr. | |
| 5,624,403 | A | | 4/1997 | Jaquith | |
| 5,664,750 | A | | 9/1997 | Cohen | |
| 5,673,888 | A | | 10/1997 | Garguilo | |
| 5,704,577 | A | | 1/1998 | Gordon | |
| 5,733,061 | A | | 3/1998 | Child | |
| 5,738,319 | A | | 4/1998 | Grassi | |
| 5,782,611 | A | * | 7/1998 | Neftel et al. | 417/234 |
| 5,806,814 | A | * | 9/1998 | White | 248/80 |
| 5,807,333 | A | | 9/1998 | Osborne et al. | |
| 5,868,710 | A | | 2/1999 | Battiato et al. | |
| 5,873,386 | A | | 2/1999 | Arosio | |
| 5,873,555 | A | | 2/1999 | Crace | |
| D407,010 | S | | 3/1999 | Sobczynski | |
| 5,876,359 | A | | 3/1999 | Bock et al. | |
| 5,937,950 | A | | 8/1999 | Adams et al. | |
| 5,940,904 | A | | 8/1999 | Lutz | |
| 6,079,678 | A | | 6/2000 | Schott et al. | |
| 6,196,503 | B1 | | 3/2001 | Cernosek et al. | |
| 6,202,266 | B1 | | 3/2001 | Van den Branden et al. | |
| 6,450,436 | B1 | | 9/2002 | Tsuji et al. | |
| 6,468,237 | B1 | | 10/2002 | Lina | |
| 6,497,539 | B2 | | 12/2002 | Marroncelli | |
| 6,560,798 | B2 | | 5/2003 | Welling et al. | |
| 6,676,678 | B2 | | 1/2004 | Gifford, III et al. | |
| 6,688,569 | B1 | | 2/2004 | Weiss | |
| 6,690,280 | B2 | | 2/2004 | Citrenbaum et al. | |
| 6,695,857 | B2 | | 2/2004 | Gifford, III et al. | |
| 6,766,674 | B2 | | 7/2004 | Simon | |
| 6,942,647 | B2 | | 9/2005 | Nickels | |
| 6,959,572 | B2 | | 11/2005 | Lawrence et al. | |
| 7,108,544 | B2 | | 9/2006 | Zoller | |
| 7,160,087 | B2 | | 1/2007 | Fathallah et al. | |
| 7,178,777 | B1 | | 2/2007 | Banker | |
| 7,232,105 | B2 | | 6/2007 | Want et al. | |
| 7,393,057 | B2 | | 7/2008 | Fraser | |
| 7,731,138 | B2 | | 6/2010 | Wiesner et al. | |
| 2001/0007298 | A1 | | 7/2001 | Glass | |
| 2001/0017340 | A1 | | 8/2001 | Cernosek et al. | |
| 2002/0096608 | A1 | | 7/2002 | Cederberg, III | |
| 2003/0070236 | A1 | | 4/2003 | Barker | |
| 2004/0035972 | A1 | | 2/2004 | Glass | |
| 2004/0195484 | A1 | | 10/2004 | Sheeran | |
| 2005/0006542 | A1 | | 1/2005 | Henning et al. | |
| 2005/0077436 | A1 | | 4/2005 | Nelson | |
| 2007/0107130 | A1 | | 5/2007 | Elhabashy | |
| 2008/0116157 | A1 | | 5/2008 | Fulbrook et al. | |
| 2008/0272254 | A1 | | 11/2008 | Harr et al. | |
| 2009/0125055 | A1 | | 5/2009 | Larkin et al. | |
| 2009/0314923 | A1 | | 12/2009 | Timoszyk et al. | |

FOREIGN PATENT DOCUMENTS

| | | | |
|---|---|---|---|
| DE | 4238955 | A1 | 7/1994 |
| DE | 297 08 363 | | 7/1997 |
| DE | 29810893 | U1 | 10/1998 |
| DE | 20206765 | U1 | 7/2002 |
| EP | 0167345 | A1 | 1/1986 |
| FR | 2664807 | A1 | 1/1992 |
| WO | 9952487 | A1 | 10/1999 |
| WO | WO 2005/082314 | A1 | 9/2005 |

* cited by examiner

MOUNT FOR A COMPRESSION CONTROL UNIT

FIELD OF THE INVENTION

The present invention generally relates to a mount for a compression control unit used to supply air under pressure to a compression device.

BACKGROUND

A major concern for immobile patients and like persons are medical conditions that form clots in the blood, such as deep vein thrombosis (DVT) and peripheral edema. Such patients and persons include those undergoing surgery, anesthesia, extended periods of bed rest, etc. The conditions and resulting risks associated with patient immobility may be controlled or alleviated by applying intermittent pressure to a patient's limb, such as, for example, a leg or foot to assist in blood circulation. For example, sequential compression devices have been used. Sequential compression devices are typically constructed of two sheets of material secured together at the seams to define one or more fluid-impervious bladders, which are connected to a source of pressure for applying sequential pressure around a patient's body parts for improving blood return to the heart. The inflatable sections are covered with a laminate to improve durability, patient comfort, and to protect against puncture. The two sheets are structurally designed to withstand a changing pressure over time under repeated use. Medical tubing is used to make connection of the source of pressure to the usually several bladders of the compression device.

The source of air pressure for the compression device is an air compressor most often located in a compression control unit. The compression control unit includes a controller to control the amount of air pressure supplied to the compression device. A user interface on the control unit allows medical personnel to input operating parameters to the controller. The compression control unit may include a mount for mounting the control unit on a bed unit in a hospital, more specifically, on a side board or a head board or a foot board, of the hospital bed unit. In one example, the mount includes a wire frame shaped generally as a hook so that the mount catches on the bed unit.

One problem associated with compression control units, particularly in a hospital setting, is excess electrical wires and/or excess fluid tubing extending from the units both during use and when the units are not in use. For example, the fluid tubing leading from the compression control unit to the compression device is typically longer than necessary so that slack is present during use. The compression control unit does not include a device that stores such excess slack when the control unit is mounted on the hospital bed unit. As such, the excess tubing may end up on the floor, adjacent to the bed, where it becomes a tripping hazard. Moreover, the compression control unit does not include a device that effectively stores the fluid tubing and the electrical cord when the control unit is not in use. As such, the fluid tubing and the electrical cord may create a tripping hazard and/or may become tangled with tubes and/or cords of other medical devices, including other compression control units.

SUMMARY OF THE INVENTION

In one aspect, a compression control unit for a compression device generally comprises a housing having a front and a back, a top and a bottom, and opposite sides, and a pump in the housing. The compression control unit also comprises an outlet port for fluidly connecting fluid tubing to the pump to deliver pressurized fluid to the compression device, and a mount on the back of the housing for mounting the compression control unit on a bed unit. The mount includes a securing portion spaced from the back of the housing and lying in a plane generally opposing the back of the housing. The securing portion partially defines a channel for receiving a part of the bed unit to secure the compression control unit to the bed unit. Spaced apart wing portions extend generally upward and laterally outward relative to the securing portion. The wing portions are configured so that the fluid tubing secured to the outlet can be wrapped around the wing portions when the compression control unit is mounted on the bed unit.

In another aspect, a mount is provided for a compression control unit for a compression device that generally comprises a housing having a front, a back, a top and a bottom, a pump in the housing, and an outlet for fluidly connecting fluid tubing to the pump to deliver pressurized fluid to the compression device. The mount generally comprises a pair of spaced apart wing portions, and a standoff portion adapted to be secured to the back of the housing of the compression control unit for spacing the wing portions from the back of the housing when the mount is secured to the compression control unit. A securing portion extends downward with respect to the standoff portion. The securing portion lies in a plane generally opposing the back of the housing when the mount is secured to the compression control unit to partially define a channel in which a part of the bed unit is received to secure the compression control unit to the bed unit. The wing portions are configured so that the fluid tubing secured to the outlet can be wrapped around the wing portions when the compression control unit is mounted on the bed unit.

BRIEF DESCRIPTION OF THE DRAWINGS

Corresponding reference characters indicate corresponding parts throughout the drawings.

DETAILED DESCRIPTION OF THE DRAWINGS

Figure 1:
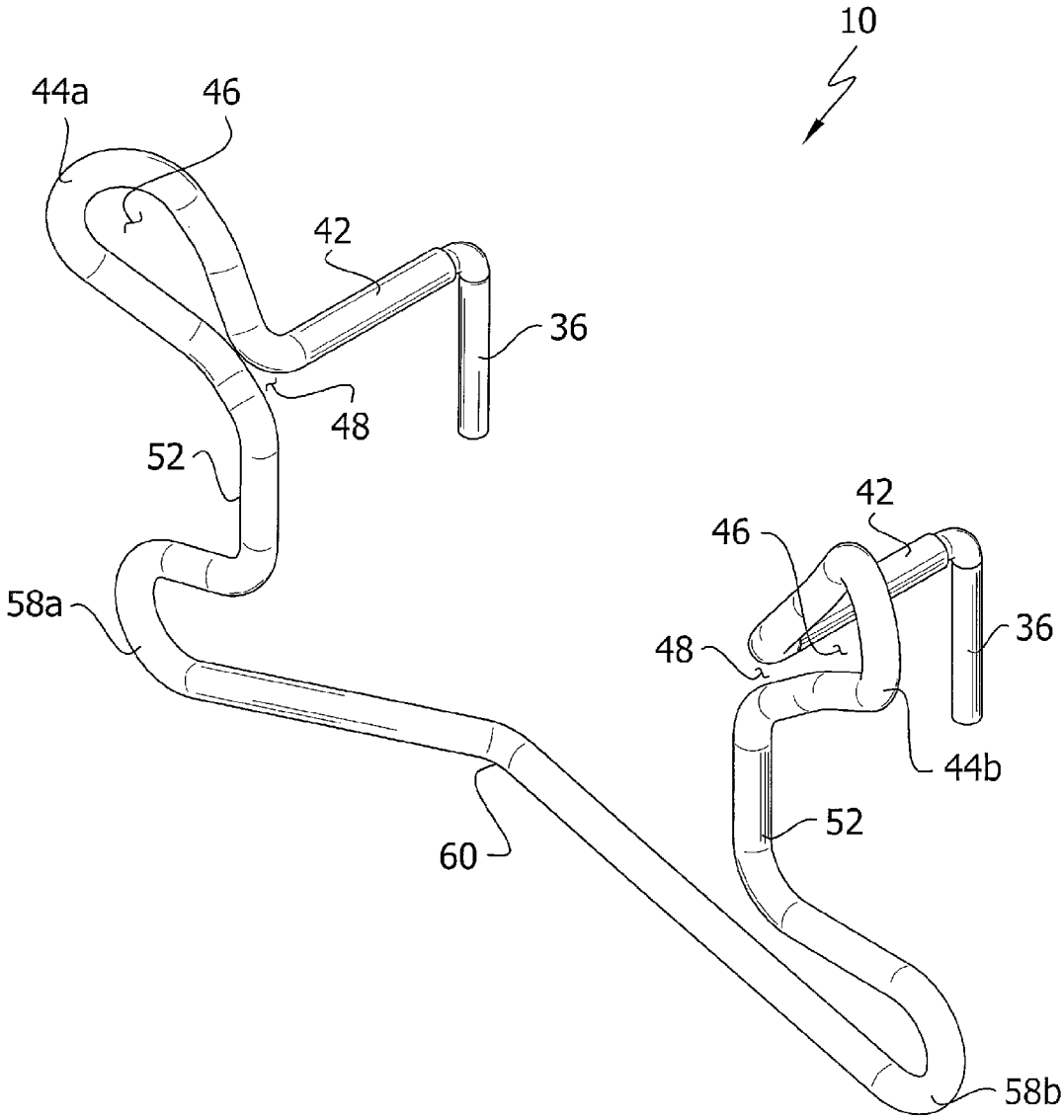
FIG. 1 is a perspective of a first embodiment of a mount for a compression control unit for a compression device.
Figure 2:
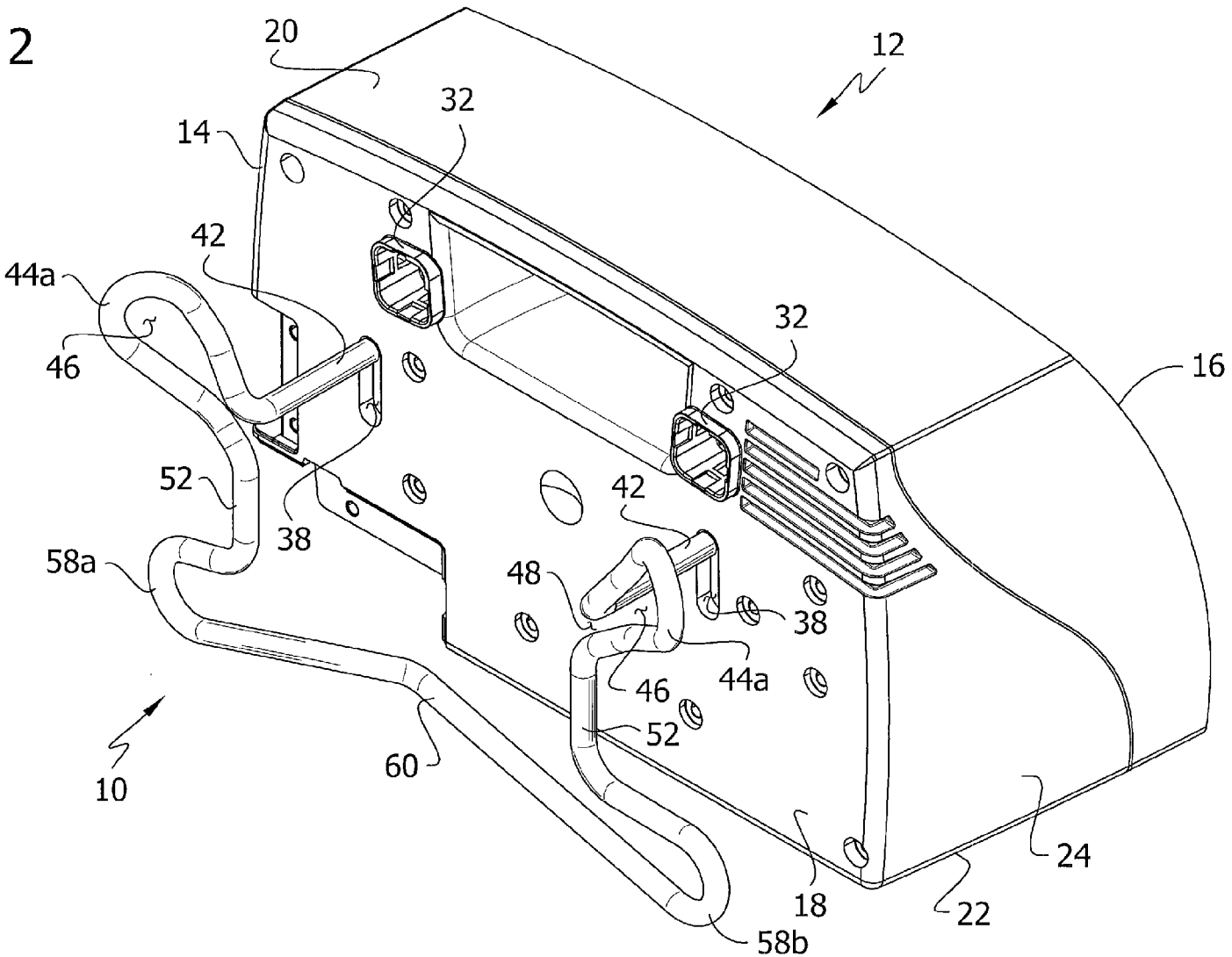
FIG. 2 is a rear perspective of a compression control unit including the mount of FIG. 1.
Figure 3:
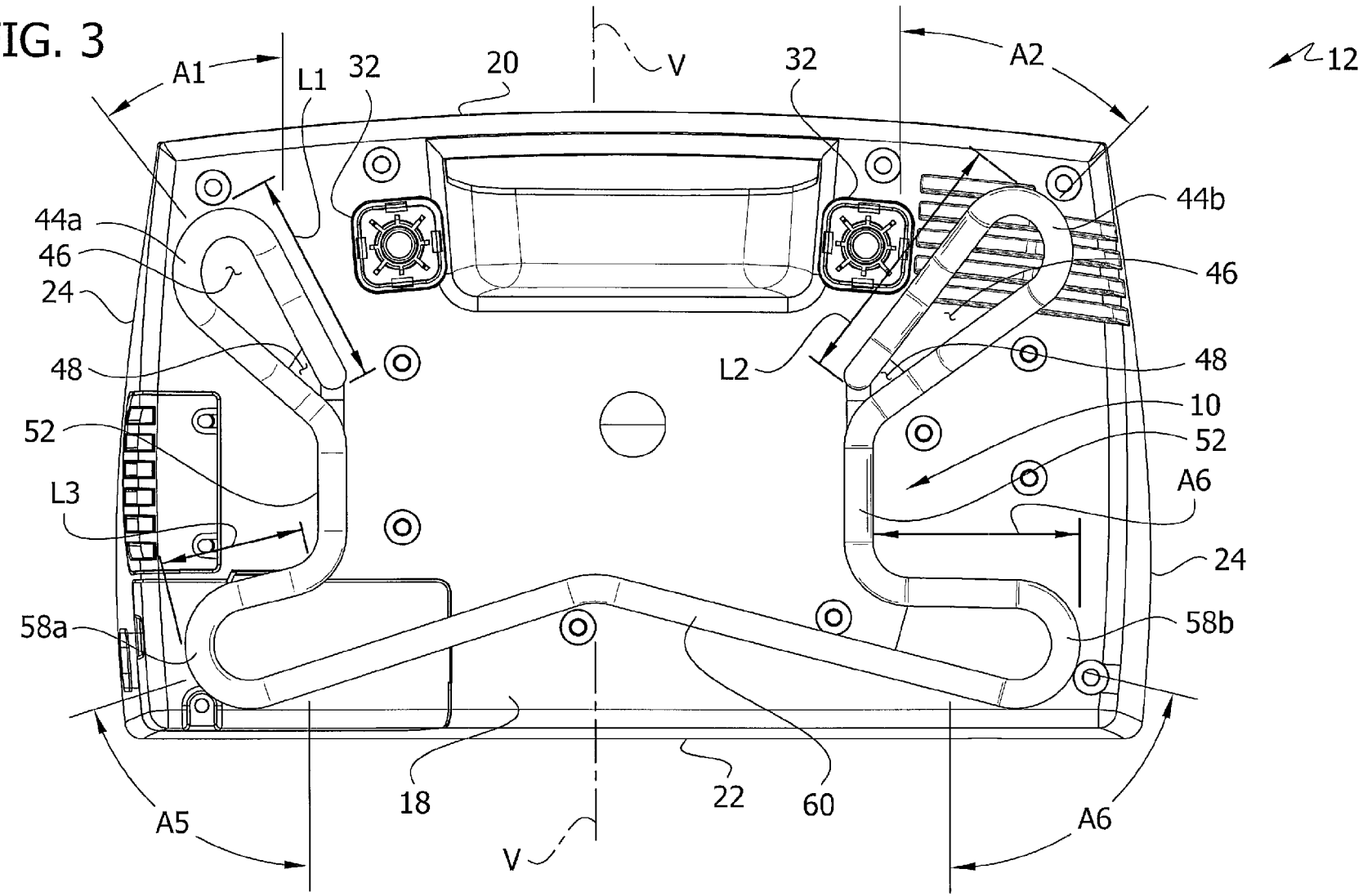
FIG. 3 is a rear elevation of the compression control unit.

Referring to FIGS. 1-5, a first embodiment of a mount, constructed according to the teachings of the present disclosure, is generally indicated at 10. As shown in FIGS. 2-6 and explained in more detail below, the mount 10 is configured to be attached to a compression control unit, generally indicated at 12, for use with a compression device, such as a compression sleeve for leg or a compression cuff for a foot. In the illustrated embodiment, the compression control unit 12 includes a housing 14 having a front 16 and a back 18, a top 20 and a bottom 22, and opposite sides 24. A pneumatic pump, indicated schematically at 26 in FIG. 6, within the housing 14 may be controlled by a controller (not shown). An electrical cord 28 (FIG. 7) allows connection to a power source. A user interface (not shown) at the front 16 of the housing 14 allows a person, such as a medical professional or a wearer of the compression device, to activate the pump 28 (FIG. 4) and/or to select a setting for the controller. The user interface may include buttons, switches, a touch screen or other components. The compression control unit 12 also includes a pair of outlet ports 32 fluidly connected to the pump 28. Flexible fluid tubing 34, e.g., two tubes (FIGS. 6 and 7), is attachable to the outlet ports 32 to fluidly connect the pump 28 to one or more compression devices.

Referring to FIGS. 2-5, the mount 10 is secured to the back 18 of the housing 14 of the compression control unit 12. In the illustrated embodiment, the mount 10 comprises a wire frame formed from a single, unitary wire that is shaped, bent or otherwise formed into separate, continuous portions. It is understood that the mount 10 may comprise a wire frame formed from a plurality of wires secured together in a suitable manner, as opposed to a single, unitary wire, without departing from the scope of the present invention. It is also understood that the mount 10 may comprise a non-wire frame (e.g., a bracket frame), as opposed to a wire frame, that includes discrete mount portions that are similar functionally, but not necessarily structurally, to the portions of the illustrated mount described herein below. The mount includes peg portions 36 (FIG. 1) received in vertical slots 38 in the back 18 of the housing 14. A standoff portion 42 extends rearward from the peg portions 36 and from the back 18 of the housing 14. In the illustrated embodiment, the standoff portion 42 comprises left and right segments of wire extending from the respective peg portions. The standoff portion 42 space the remainder of the mount 10 from the back 18 of the housing 14. As explained in more detail below, spaced apart left and right upper wing portions 44*a*, 44*b*, respectively, of the mount 10 extend upward and laterally outward from the standoff portion 42. The left and right upper wing portions 44*a*, 44*b* may extend laterally outward from the standoff portion 42 at angles $A_1$, $A_2$, respectively (FIG. 3), within a range of 15 degrees and 60 degrees, more preferably, within a range of 30 degrees and 45 degrees. In the illustrated embodiment, each of the upper wing portions 44*a*, 44*b* extend laterally outward from the standoff portion 42 at angles of 28 and 38 degrees, respectively. The left and right upper wing portions 44*a*, 44*b* may have lengths $L_1$ and $L_2$, respectively (FIG. 3), as measured from the standoff portion 42. The lengths $L_1$, $L_2$ may be in a range of between about 1.5 in (3.8 cm) and about 2.4 in (6.1 cm).

In the illustrated embodiment, the single, unitary wire of the mount 10 is looped to form each of the upper wing portions 44*a*, 44*b*. In this embodiment, the looped upper wing portions 44*a*, 44*b* each define an opening 46 that is sized and shaped to receive and retain a free end margin of the fluid tubing 34 and/or a free end margin of the electrical cord 28. More specifically, the opening 46 is a slot having a narrow entrance 48 for receiving the fluid tubing 34 and/or the electrical cord 28 and preventing the fluid tubing and/or the electrical cord from unintentionally withdrawing from the slot. Each slot 46 flares or widens outward from the entrance 48. Other ways of forming the upper wing portions 44*a*, 44*b*, including other ways of forming openings in the wing portions for receiving the fluid tubing 34 and/or the electrical cord 28, do not depart from the scope of the present invention.

Figure 4:
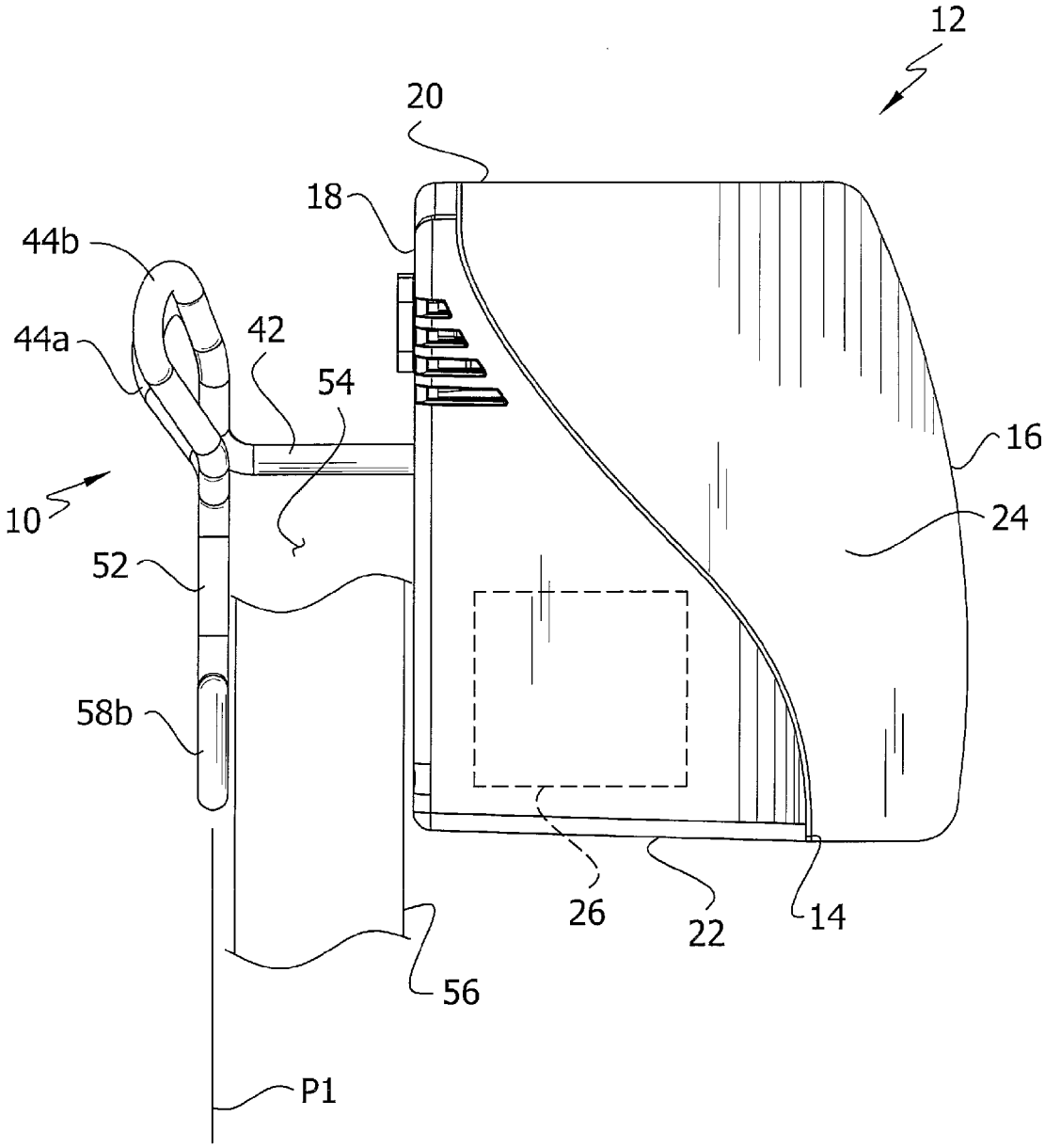
FIG. 4 is a left side elevation of the compression control unit.
Figure 5:
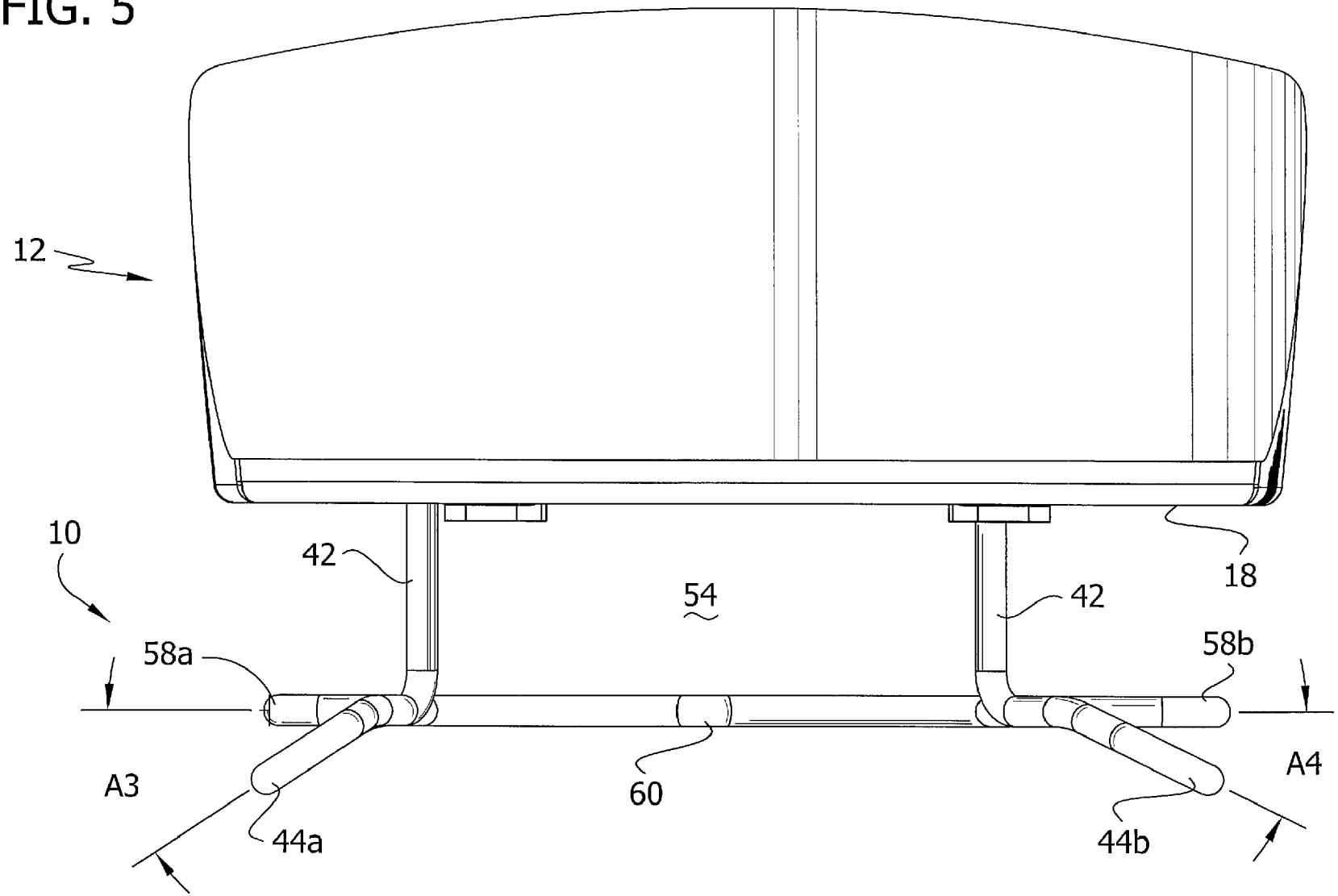
FIG. 5 is a top plan of the compression control unit.
Figure 10:
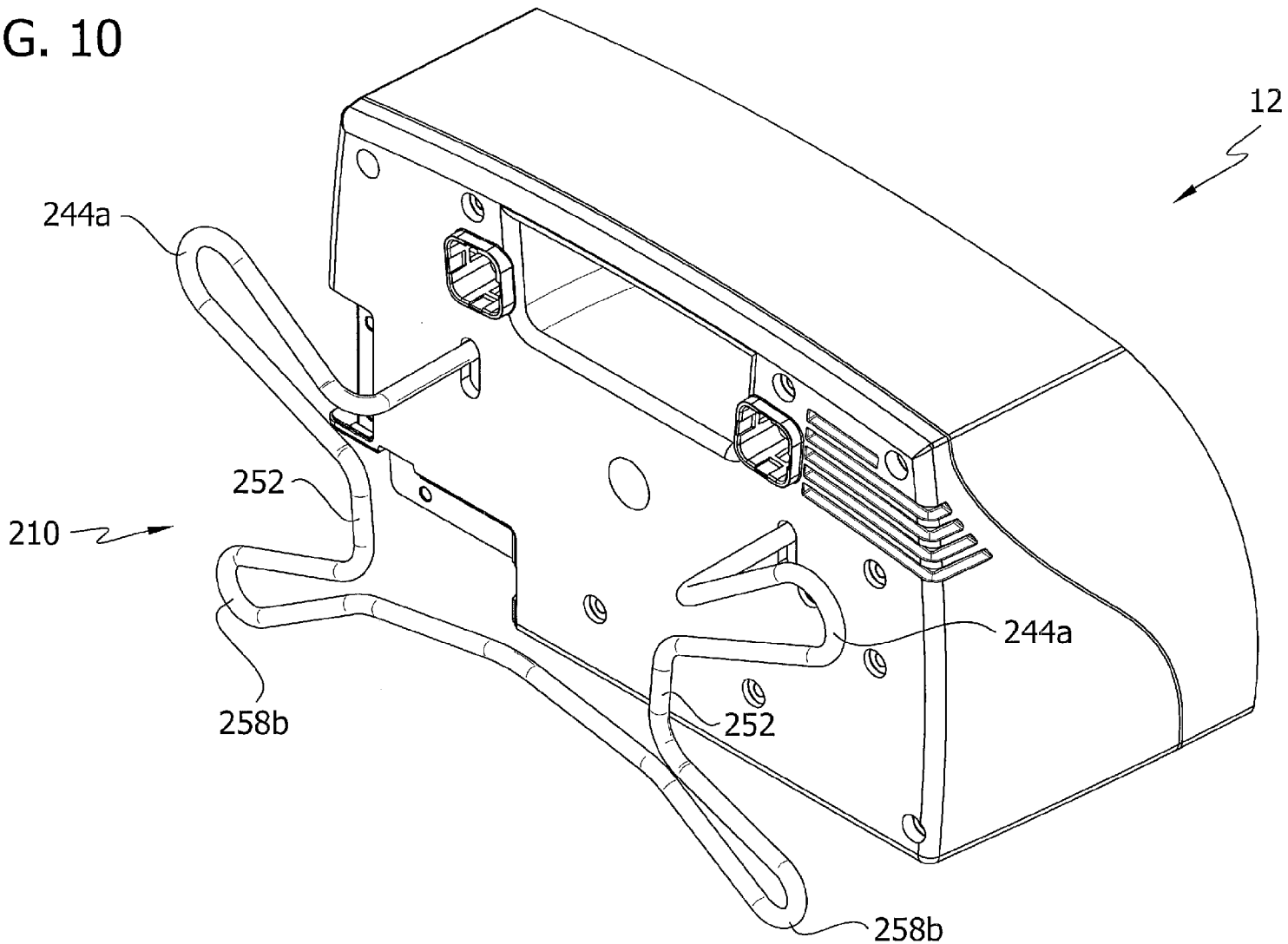
FIG. 10 is a rear perspective of a compression control unit for a compression device including a mount of a third embodiment.

A securing portion 52 extends downward from the upper wing portions 44*a*, 44*b*. In the illustrated embodiment, the securing portion comprises left and right segments of wire extending downward from respective left and right upper wing portions 44*a*, 44*b*. From another perspective, it can be said that the upper wing portions 44*a*, 44*b* extend upward and laterally outward from the securing portion 52. The securing portion 52 is spaced from the back 18 of the housing 14 and lies in a plane $P_1$ generally opposing the back of the housing. For example, the securing portion 52 may be spaced about 1.775 in (4.51 cm) from the back 18 of the housing 14, as in the illustrated embodiment. Referring to FIGS. 4 and 10, the securing portion 52 combined with the standoff portion 42 and the back 18 of the housing 14 define a channel 54 in which a part of a bed unit 56 (e.g., a side rail or board, a foot rail or board or a head rail or board) is received to secure the compression control unit 12 to the bed unit.

In the illustrated embodiment and as shown best in FIG. 4, the upper wing portions 44*a*, 44*b* extend out-of-plane (e.g., rearward) with respect to the plane $P_1$ of the securing portion 52. In one example, the left and right upper wing portions 44*a*, 44*b* extend at out-of-plane angles $A_3$, $A_4$, respectively (FIG. 5), with respect to the securing portion that are within a range between about 10 degrees and about 40 degrees, more specifically between about 15 degrees and 35 degrees. In the illustrated embodiment, angles $A_3$ and $A_4$ are 33 and 26 degrees, respectively. The upper wing portions 44*a*, 44*b* may extend out-of-plane at other angles or may extend in-plane without departing from the scope of the present invention.

In the illustrated embodiment, optional left and right lower wing portions 58*a*, 58*b*, respectively, extend downward and laterally outward from the securing portion 52. (It is understood that the mount may not include lower wing portions without departing from the scope of the present invention.) The left and right lower wing portions 58*a*, 58*b* extend laterally outward from the standoff portion 42 at angles $A_5$, $A_6$, respectively (FIG. 3), within a range of 15 degrees and 60 degrees, and more preferably within a range of 30 degrees and 45 degrees. In the illustrated embodiment, angles $A_5$ and $A_6$ are 70 and 77 degrees, respectively, with respect to axis V. An arched portion 60 of the mount 10 connects the lower wing portions 58*a*, 58*b*. In the illustrated embodiment of FIGS. 1-5, the lower wing portions 58*a*, 58*b* are generally in-plane (i.e., coplanar) with respect to the securing portion 52. In the illustrated embodiment, the single, unitary wire 10 is looped to form each of the lower wing portions 58*a*, 58*b*. Other ways of forming the lower wing portions 58*a*, 58*b* do not depart from the scope of the present invention. The left and right lower wing portions 58*a*, 58*b* have lengths $L_3$, $L_4$, respectively (FIG. 3) measuring from the securing portion 52. In the illustrated embodiment, the length $L_3$ of the left lower wing portion 58*a* is less than the length $L_4$ of the right lower wing portion 58*b*, although it is understood that the left lower wing portion may be shorter than the right lower wing portion or the lower wing portions may have equal lengths. In one example, the length $L_3$ of the shorter, left lower wing portion 58*a* is about 1.55 in (3.94 cm), and the length $L_4$ of the longer, right lower wing portion is about 1.18 in (3.00 cm). This configuration makes the mount 10 asymmetrical about a vertical axis V (FIG. 3) so that the mount does not block mounting holes on the back 18 of the housing 14 of the control unit 12.

Figure 6:
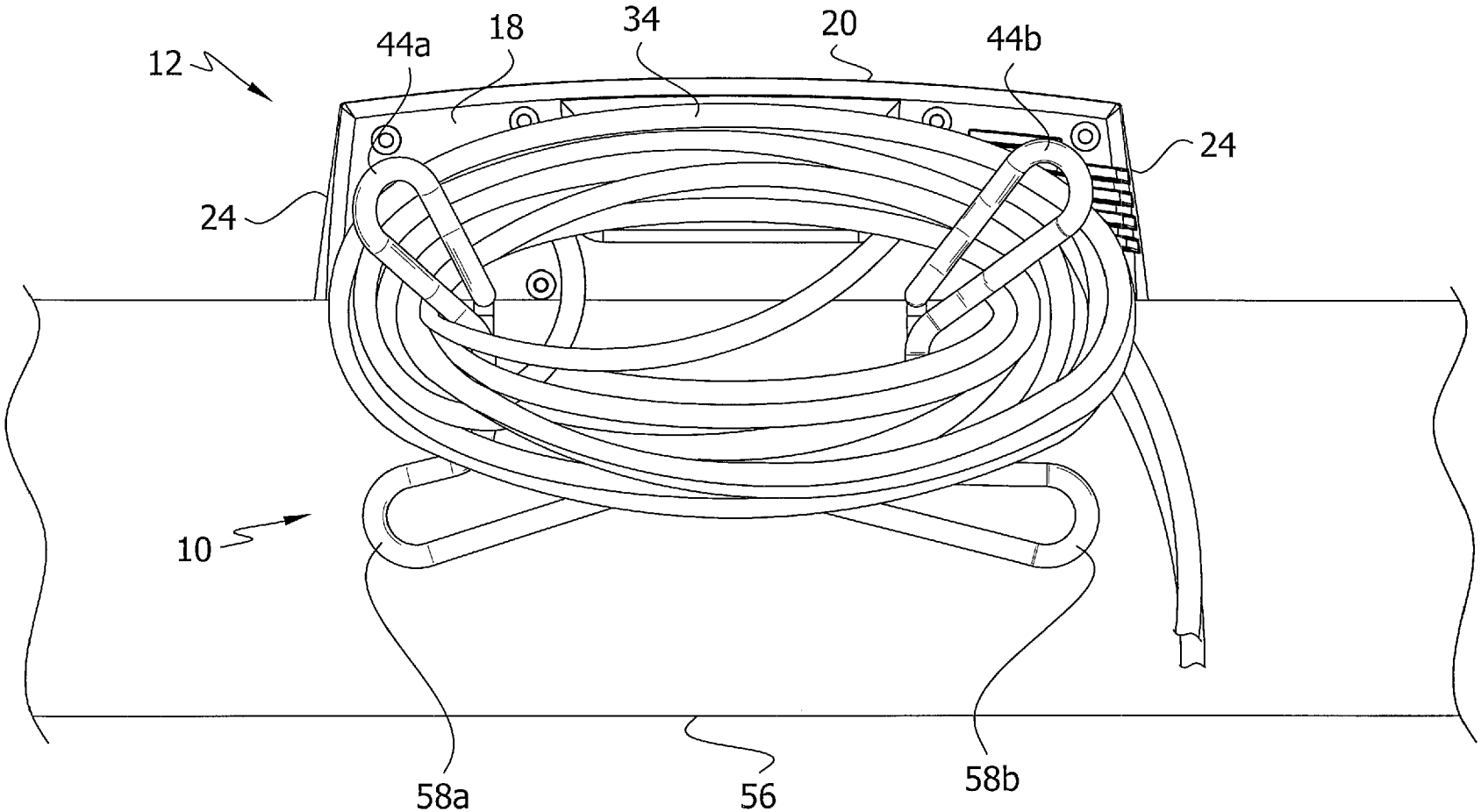
FIG. 6 is a rear elevation of the compression control unit mounted on a bed unit with excess fluid tubing stowed on the mount.
Figure 7:
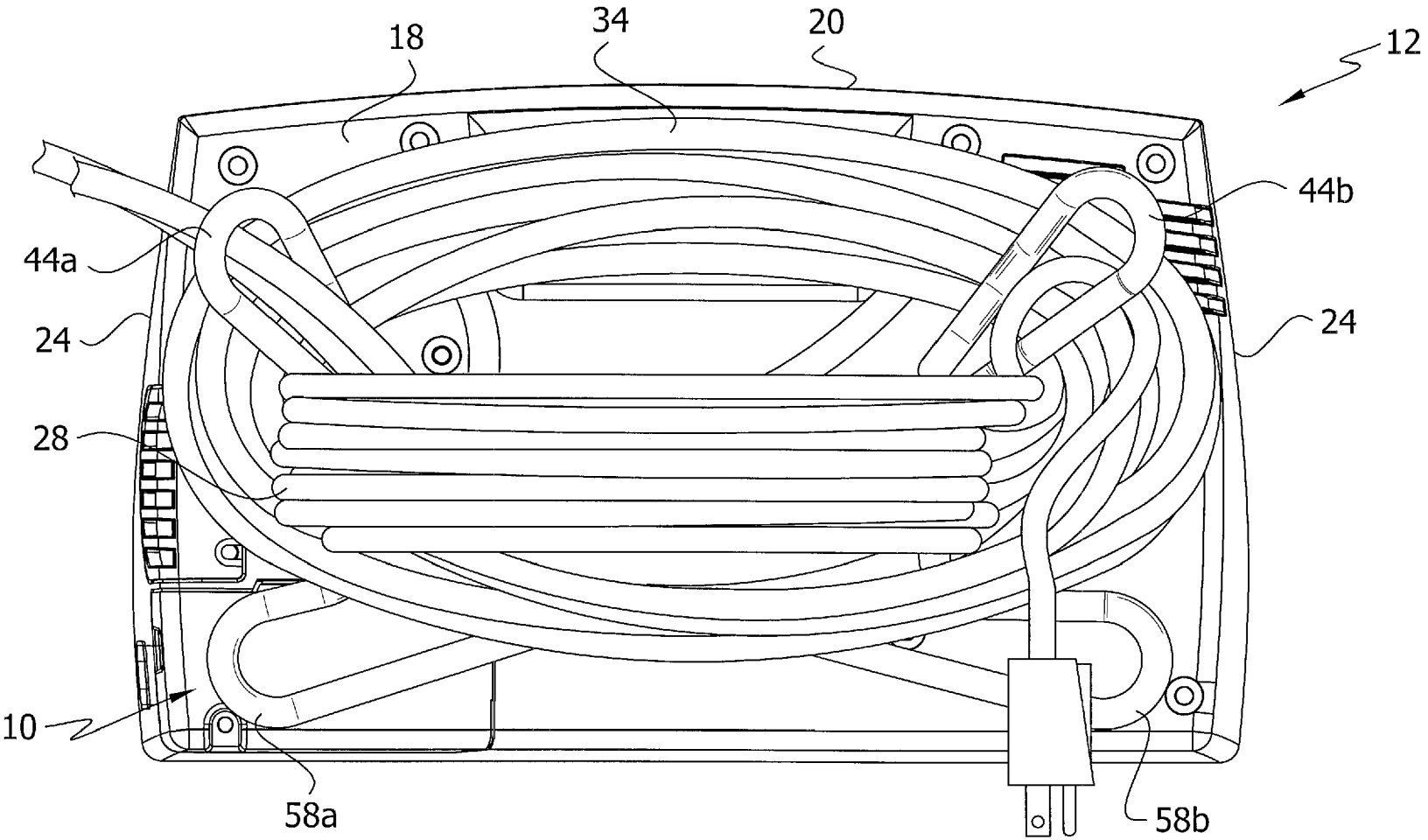
FIG. 7 is a rear elevation of the compression control unit with fluid tubing and an electrical cord stowed on the mount.

The mount 10 is configured so that excess fluid tubing 34 can be stowed on the mount when the compression control unit 12 is secured to the bed unit 56, as shown in FIG. 6. During the use, the excess fluid tubing can be wrapped around the upper wing portions 44*a*, 44*b*. The illustrated mount 10 provides an increased space between the back 18 of the compression control unit 12 and the upper wing portions 44*a*, 44*b* because the upper wing portions extend rearward, out-of-plane from the securing portion 52. In addition, the mount 10 is also configured so that the fluid tubing 34 and the electrical cord 28 can be concurrently stowed on the mount, such as when the compression control unit 12 is not in use (e.g., in storage). Referring to FIG. 7, both the fluid tubing 34 (e.g., two fluid tubes) and the electrical cord 28 are wrapped around the mount 10. The fluid tubing 34 is wrapped around the standoff portion 42 in the area between the housing 14 and the upper and lower wing portions 44*a*, 44*b*, 58*a*, 58*b*, respectively. The free end portion(s) of the fluid tubing 34 is secured in the slot 46 of the left upper wing portion. Referring still to FIG. 7, the electrical cord 28 is wrapped around the securing portion 52 between the upper and lower wing portions 44*a*, 44*b*, 58*a*, 58*b*, respectively. A free end portion of the electrical cord 28 (i.e., prong end) is secured in the slot 46 of the right upper wing portion 44*b*. In another example, both the fluid tubing 34 and the electrical cord 28 can be wrapped around the standoff portion 42 between the upper and lower wing portions 44*a*, 44*b*, 58*a*, 58*b*, respectively. Other ways of wrapping the fluid tubing 34 and/or the electrical cord 28 using the mount 10 do not depart from the scope of the invention.

Figure 8:
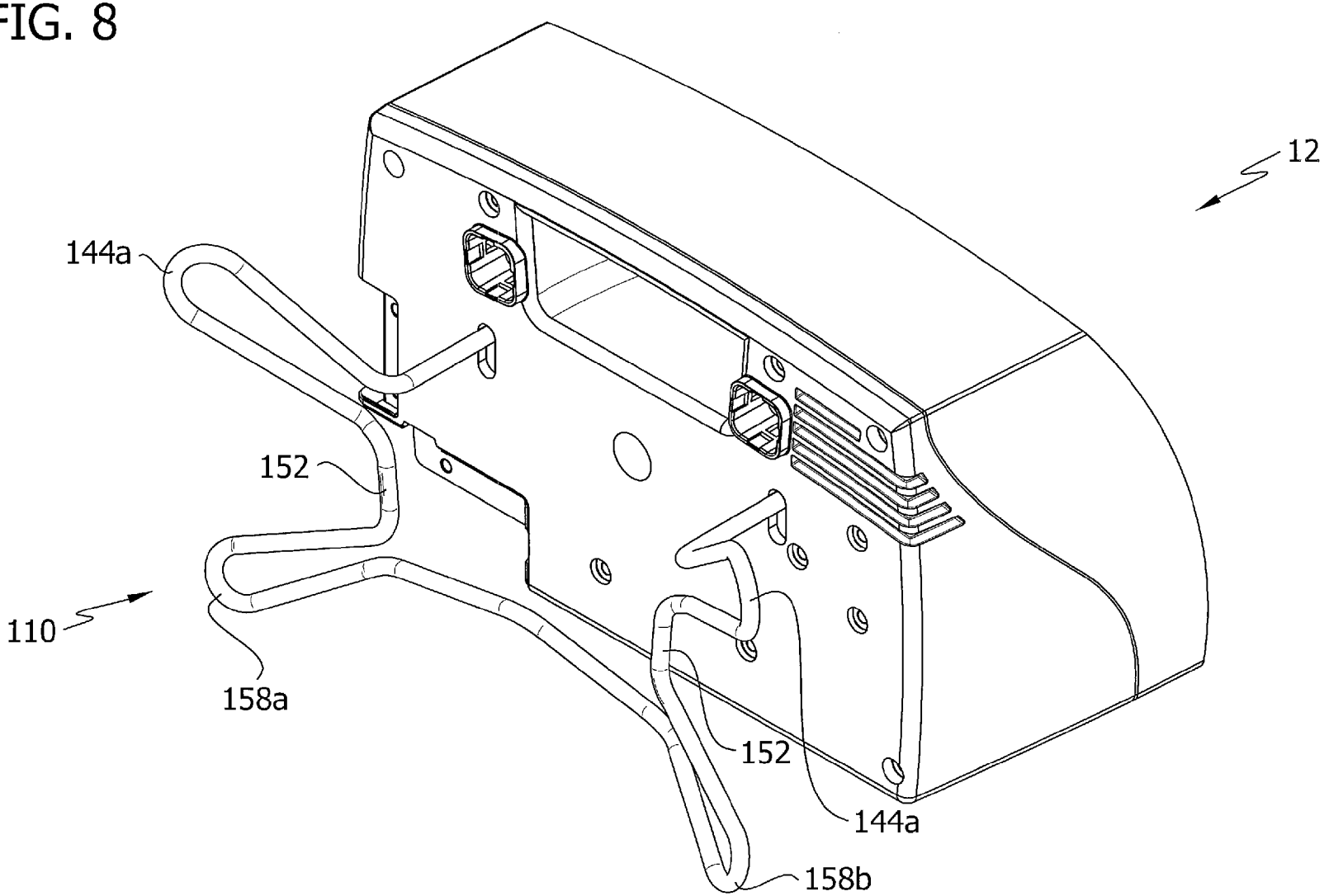
FIG. 8 is a rear perspective of a compression control unit for a compression device including a mount of a second embodiment.
Figure 9:
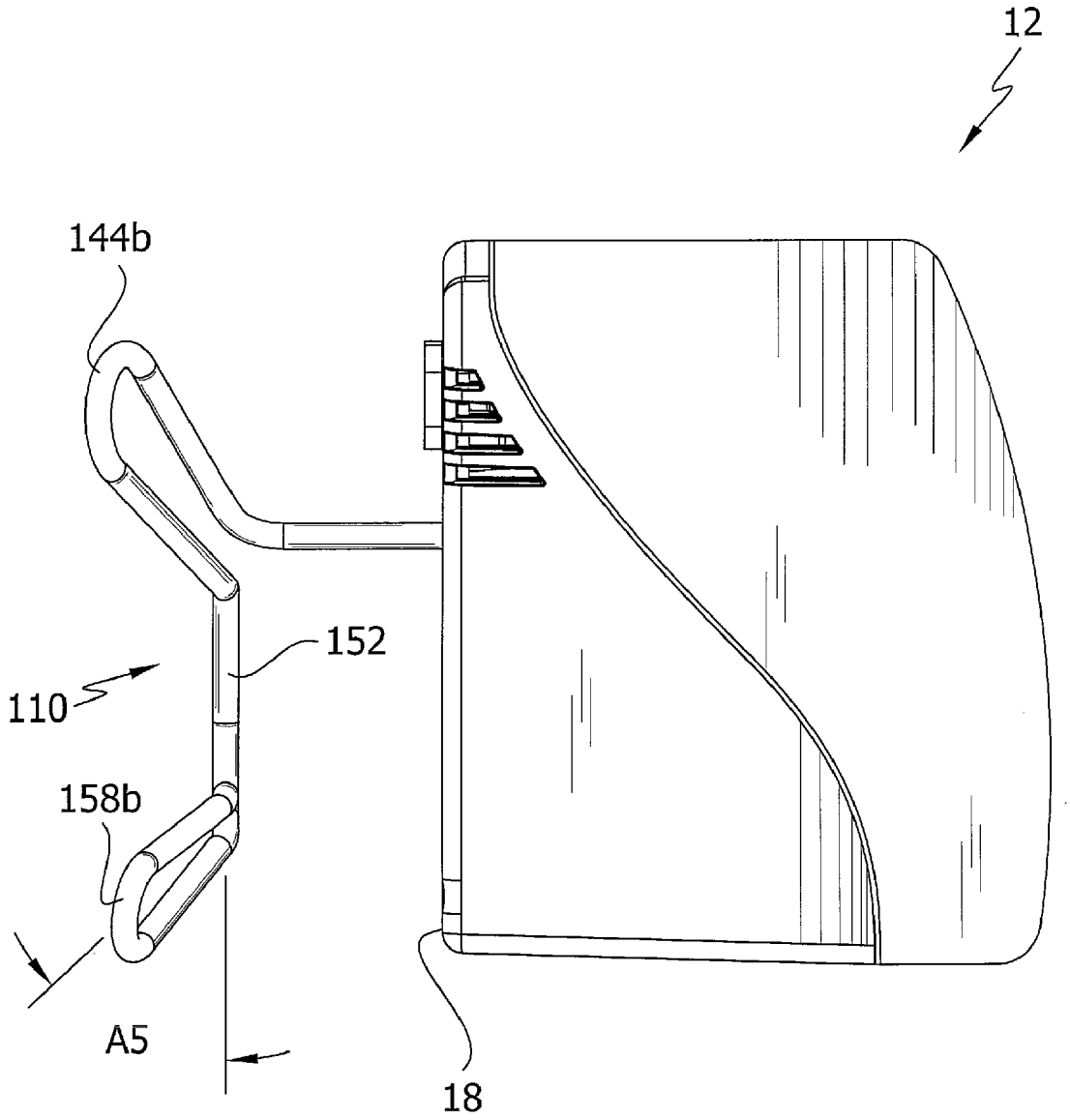
FIG. 9 is a left side elevation of the compression control unit of FIG. 8.

It is contemplated that, in other embodiments, the lower wing portions may be out-of-plane with respect to the securing portion. For example, in a second embodiment of the mount, generally indicated by reference numeral 110 in FIGS. 8 and 9, the mount is similar to the first embodiment except that lower wing portions 158*a*, 158*b* are out-of-plane of the securing portion 152. (Like components are indicated by corresponding reference numerals plus 100.) In the second embodiment, the lower wing portions 158*a*, 158*b* may extend at out-of-plane angles $A_5$ with respect to the securing portion 152 within a range between about 10 degrees and about 40 degrees, more specifically between about 15 degrees and 35 degrees. In the illustrated embodiment, angles $A_3$ and $A_4$ are 33 and 26 degrees, respectively. These angle ranges could extend to the lower two sections 258*b*. In the illustrated second embodiment, the angles at which the lower wing portions 158*a*, 158*b* out-of-plane with respect to the securing portion 152 are equal and are substantially equal to the angles at which the upper wing portions 144*a*, 144*b* extend out-of-plane with respect to the securing portion.

Figure 11:
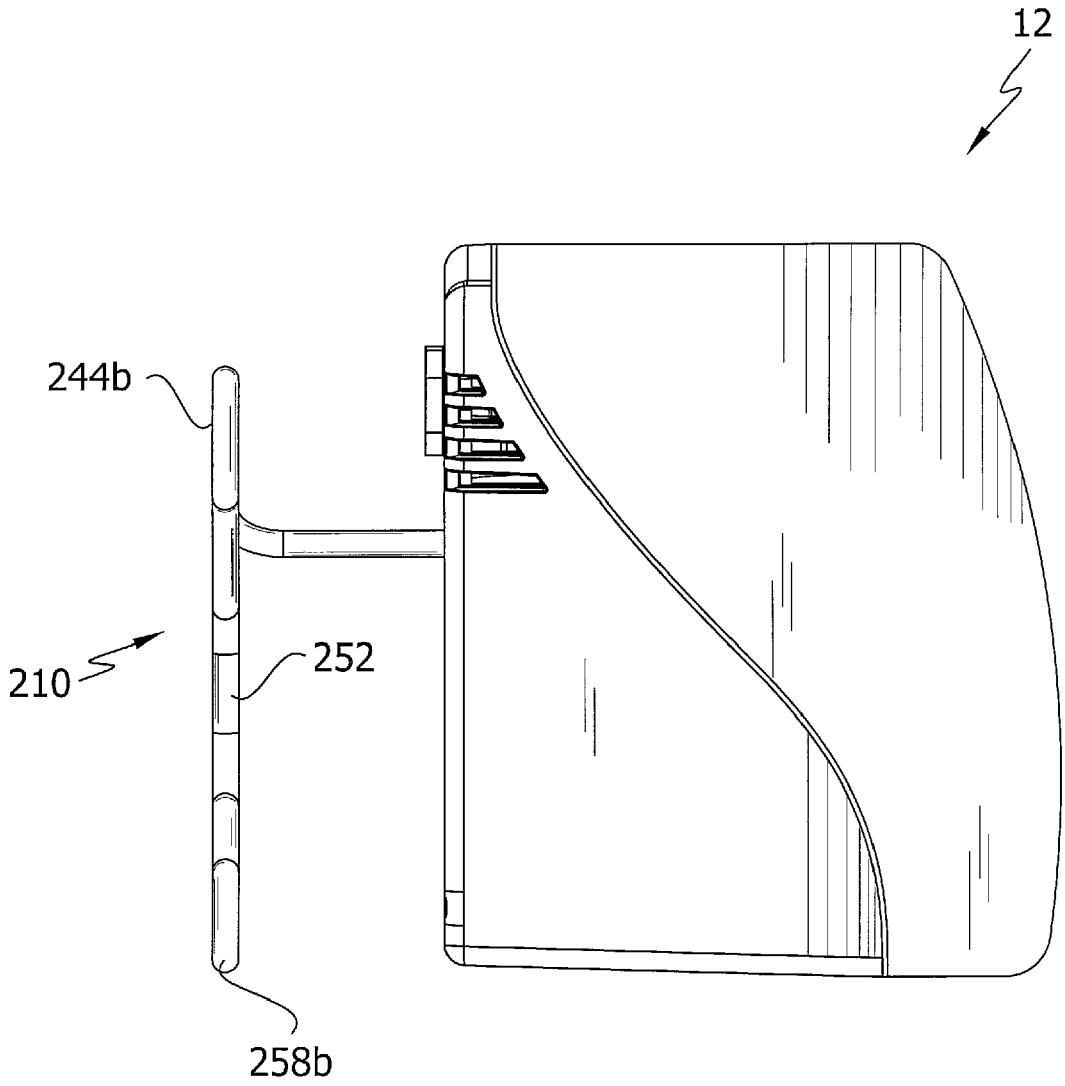
FIG. 11 is a left side elevation of the compression control unit of FIG. 10.

It is contemplated that, in other embodiments, both the upper wing portions and the lower wing portions may be in-plane (coplanar) with respect to the securing portion. For example, referring to FIGS. 10 and 11, a third embodiment 210 is similar to the first embodiment 10, with like components being indicated by corresponding reference numerals plus 200, except that the upper wing portions 244*a*, 244*b* and the lower wing portions 258*a*, 258*b* are in-plane with respect to the securing portion 252. It is understood that the lower wing portions may be out-of-plane and the upper wing portions may in-plane without departing from the scope of the present invention. It is also contemplated that the mount may not include the lower wing portions without departing from the scope of the present invention.

When introducing elements of the present invention or the preferred embodiments thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions, products, and methods without departing from the scope of the invention, it is intended that all matter contained in the above description and shown in the accompanying drawings shall be interpreted as illustrative and not in a limiting sense.

What is claimed is:

1. A compression control unit for a compression device comprising:

a housing having a front and a back, a top and a bottom, and opposite sides;

a pump in the housing;

an outlet port for fluidly connecting fluid tubing to the pump to deliver pressurized fluid to the compression device;

a mount on the back of the housing for mounting the compression control unit on a bed unit, the mount including a securing portion spaced from the back of the housing and lying in a plane generally opposing the back of the housing, the securing portion partially defining a channel for receiving a part of the bed unit to secure the compression control unit to the bed unit, and spaced apart wing portions extending generally upward and laterally outward relative to the securing portion, the wing portions being configured so that the fluid tubing secured to the outlet can be wrapped around the wing portions when the compression control unit is mounted on the bed unit, wherein the wing portions are upper wing portions, and wherein the mount includes spaced apart lower wing portions extending downward and laterally outward from the securing portion, wherein the upper wing portions extend generally rearward away from the housing and out-of-plane of the securing portion.

2. A compression control unit as set forth in claim 1 wherein the lower wing portions are generally coplanar with the securing portion.

3. A compression control unit as set forth in claim 2 wherein the mount comprises a single, unitary wire shaped to define the securing portion and the upper and lower wing portions.

4. A compression control unit as set forth in claim 1 wherein the upper wing portions extend at an out-of-plane angle with respect to the plane of the securing portion, wherein the out-of-plane angle is within a range between about 10 degrees and about 40 degrees.

5. A compression control unit as set forth in claim 4 wherein the range of the out-of-plane angle is between about 15 degrees and about 25 degrees.

6. A compression control unit as set forth in claim 1 wherein the lower wing portions extend generally rearward away from the housing and out-of-plane of the securing portion.

7. A compression control unit as set forth in claim 1 wherein at least one of the upper wing portions defines an opening sized and shaped for receiving a free end portion of the fluid tubing.

8. A compression control unit as set forth in claim 1 wherein the mount is a wire frame.

9. A mount for a compression control unit for a compression device comprising a housing having a front, a back, a top and a bottom; a pump in the housing; and an outlet for fluidly connecting fluid tubing to the pump to deliver pressurized fluid to the compression device, the mount comprising:

a pair of spaced apart wing portions;

a standoff portion adapted to be secured to the back of the housing of the compression control unit for spacing the wing portions from the back of the housing when the mount is secured to the compression control unit;

a securing portion extending downward with respect to the standoff portion, the securing portion lying in a plane generally opposing the back of the housing when the mount is secured to the compression control unit to partially define a channel in which a part of the bed unit is received to secure the compression control unit to the bed unit, wherein the wing portions are configured so that the fluid tubing secured to the outlet can be wrapped around the wing portions when the compression control unit is mounted on the bed unit, wherein the wing portions are upper wing portions, and wherein the mount includes spaced apart lower wing portions extending downward and laterally outward from the securing portion, wherein the upper wing portions extend out-of-plane of the securing portion.

10. A mount as set forth in claim 9 wherein the lower wing portions are generally coplanar with the securing portion.

11. A mount as set forth in claim 10 wherein the mount comprises a single, unitary wire shaped to define the securing portion and the upper and lower wing portions.

12. A mount as set forth in claim 9 wherein the lower wing portions extend out-of-plane of the securing portion.

13. A mount as set forth in claim 9 wherein at least one of the upper wing portions defines an opening sized and shaped for receiving a free end margin of the fluid tubing.

14. A mount as set forth in claim 9 wherein the mount is a wire frame.

15. A mount for a compression control unit for a compression device comprising a housing having a front, a back, a top and a bottom; a pump in the housing; and an outlet for fluidly connecting fluid tubing to the pump to deliver pressurized fluid to the compression device, the mount comprising:

a pair of spaced apart wing portions;

a standoff portion adapted to be secured to the back of the housing of the compression control unit for spacing the wing portions from the back of the housing when the mount is secured to the compression control unit;

a securing portion extending downward with respect to the standoff portion, the securing portion lying in a plane generally opposing the back of the housing when the mount is secured to the compression control unit to partially define a channel in which a part of the bed unit is received to secure the compression control unit to the bed unit, wherein the wing portions are configured so that the fluid tubing secured to the outlet can be wrapped around the wing portions when the compression control unit is mounted on the bed unit, wherein at least one of the wing portions defines an opening sized and shaped for receiving a free end margin of the fluid tubing.

16. A mount as set forth in claim 15 in combination with compression control unit, the compression control unit comprising:

a housing having a front and a back, a top and a bottom, and opposite sides;

a pump in the housing; and an outlet port for fluidly connecting fluid tubing to the pump to deliver pressurized fluid to the compression device, wherein the mount is on the back of the housing.

17. A compression control unit for a compression device comprising:

a housing having a front and a back, a top and a bottom, and opposite sides;

a pump in the housing;

an outlet port for fluidly connecting fluid tubing to the pump to deliver pressurized fluid to the compression device;

a mount on the back of the housing for mounting the compression control unit on a bed unit, the mount including a securing portion spaced from the back of the housing and lying in a plane generally opposing the back of the housing, the securing portion partially defining a channel for receiving a part of the bed unit to secure the compression control unit to the bed unit, and spaced apart wing portions extending generally upward and laterally outward relative to the securing portion, the wing portions being configured so that the fluid tubing secured to the outlet can be wrapped around the wing portions when the compression control unit is mounted on the bed unit, wherein the wing portions extend generally rearward away from the housing and out-of-plane of the securing portion, wherein the wing portions extend at an out-of-plane angle with respect to the plane of the securing portion, the out-of-plane angle being within a range between about 10 degrees and about 40 degrees.

18. A compression control unit as set forth in claim 17 wherein the range of the out-of-plane angle is between about 15 degrees and about 25 degrees.

* * * * *